US009663885B2

(12) United States Patent
Frost et al.

(10) Patent No.: US 9,663,885 B2
(45) Date of Patent: May 30, 2017

(54) METHOD FOR SELECTIVE DISPLAY OF YARN IN A TUFTED FABRIC WITH DOUBLE END YARN DRIVES

(71) Applicants: Steven L. Frost, Chattanooga, TN (US); Mike Bishop, Chattanooga, TN (US); Brian K. Lovelady, Chattanooga, TN (US); Paul E. Beatty, Chattanooga, TN (US); Michael R. Morgante, Chattanooga, TN (US); Jeff Smith, Chattanooga, TN (US)

(72) Inventors: Steven L. Frost, Chattanooga, TN (US); Mike Bishop, Chattanooga, TN (US); Brian K. Lovelady, Chattanooga, TN (US); Paul E. Beatty, Chattanooga, TN (US); Michael R. Morgante, Chattanooga, TN (US); Jeff Smith, Chattanooga, TN (US)

(73) Assignee: Tuftco Corporation, Chattanooga, TN (US)

( * ) Notice: Subject to any disclaimer, the term of this patent is extended or adjusted under 35 U.S.C. 154(b) by 487 days.

(21) Appl. No.: 14/151,801

(22) Filed: Jan. 9, 2014

(65) Prior Publication Data

US 2014/0283724 A1 Sep. 25, 2014

Related U.S. Application Data

(60) Provisional application No. 61/750,755, filed on Jan. 9, 2013.

(51) Int. Cl.

| | |
|---|---|
| ***D05C 15/20*** | (2006.01) |
| ***D05C 15/30*** | (2006.01) |
| ***D05C 15/32*** | (2006.01) |
| ***D05C 15/34*** | (2006.01) |

(52) U.S. Cl.

CPC ..... *D05C 15/20* (2013.01); *D05C 15/30* (2013.01); *D05C 15/32* (2013.01); *D05C 15/34* (2013.01)

(58) Field of Classification Search

CPC ..... D05C 5/30; D05C 15/32; D05C 15/34

See application file for complete search history.

(56) References Cited

U.S. PATENT DOCUMENTS

| | | | | | |
|---|---|---|---|---|---|
| 4,103,629 | A * | 8/1978 | Card | D05C 15/36 | 112/80.51 |
| 4,549,496 | A * | 10/1985 | Kile | D05C 15/18 | 112/80.08 |
| 4,557,208 | A * | 12/1985 | Ingram | D05C 15/26 | 112/475.23 |
| 4,841,886 | A | 6/1989 | Watkins | | |
| 5,080,028 | A * | 1/1992 | Ingram | D05C 15/18 | 112/80.08 |

(Continued)

OTHER PUBLICATIONS

Nedgraphics, Vision Tuft 2004 User Guide, Self published, U.S.

(Continued)

*Primary Examiner* — Danny Worrell

(74) *Attorney, Agent, or Firm* — Douglas T. Johnson; Miller & Martin

(57) ABSTRACT

A novel method of tufting carpets is provided to allow the use of four or more colors of yarn at sufficient stitch density to provide for a solid appearance of any of the selected colors at any location on the carpet, and utilizing natural tacking of rear yarns to minimize loose yarn on the backing.

18 Claims, 8 Drawing Sheets

(56) References Cited

U.S. PATENT DOCUMENTS

| | | | | | |
|---|---|---|---|---|---|
| 5,165,352 | A * | 11/1992 | Ingram | D05C 15/34 | 112/80.08 |
| 5,224,434 | A | 7/1993 | Card | | |
| 5,267,520 | A | 12/1993 | Ingram | | |
| 5,392,723 | A | 2/1995 | Kaju | | |
| 5,566,630 | A * | 10/1996 | Burgess | D05C 15/32 | 112/80.41 |
| 5,983,815 | A * | 11/1999 | Card | D05C 15/32 | 112/80.73 |
| 6,224,203 | B1 * | 5/2001 | Wotton | B41J 11/005 | 347/101 |
| 6,228,460 | B1 * | 5/2001 | Hamilton | D05C 15/34 | 112/80.01 |
| 6,439,141 | B2 * | 8/2002 | Morgante | D05C 15/18 | 112/475.23 |
| 6,550,407 | B1 * | 4/2003 | Frost | D05C 15/32 | 112/220 |
| 7,222,576 | B2 * | 5/2007 | Kilgore | D05C 15/22 | 112/80.5 |
| 7,634,326 | B2 * | 12/2009 | Christman, Jr. | D05C 15/26 | 112/470.01 |
| 7,814,850 | B2 * | 10/2010 | Bearden | D05C 15/34 | 112/220 |
| 8,141,505 | B2 * | 3/2012 | Hall | D05C 15/26 | 112/80.23 |
| 8,240,263 | B1 * | 8/2012 | Frost | D05C 15/30 | 112/475.23 |
| 8,359,989 | B2 | 1/2013 | Hall | | |
| 9,222,207 | B2 * | 12/2015 | Weiner | D05C 15/30 | |
| 2014/0283724 | A1 * | 9/2014 | Frost | D05C 15/30 | 112/475.23 |

OTHER PUBLICATIONS

Nedgraphics, Texcelle 2007 User Guide, Self published, U.S.
Tuftco Corp., Tuftco Design System Suite for Windows 2000, 2006. Self published, U.S.
Declaration of Ian Slattery filed in connection with Inter Partes Review No. IPR2015-00505.
Cobble Tufting Machine Company, Inc. ColorTec Operating and Maintenance Manual Servotec Software Version 3.10. xx Apr. 2005.
Windows PCCI Operator's Manual, Verision 1.0, dated Mar. 13, 1998.
Official Transcription of Proceedings held on Apr. 7, 2016 before the Honorable Travis R. McDonough, filed Apr. 8, 2016, *Card-Monroe Corp.* v. *Tufto Corp.*, E.D. Tenn., Case No. 1 :14-cv-292.
Defendant's Notice of Filing of Declaration of Ian Slattery, filed Apr. 14, 2016, *Card-Monroe Corp.* v *Tuftco Corp.*, E.D. Tenn., Case No. 1:14-cv-292 with Exhibits A-E.
Memorandum Opinion, filed Jun. 9, 2016, *Card-Monroe Corp.* v. *Tuftco Corp.*, E.D. Tenn., Case No. 1:14-cv-292.
Nedgraphics, Floor Design Woven Carpets & Rugs, Tuft & Hard Flooring, 2010, Self published, U.S.
Cobble, Full Repeat Scroll Brochure, Self published, approx. 2002.
Crawshaw, Carpet Manufacture, Chap. 7 Patterning Systems for Tufted Carpets, WRONZ Developments 2002.
Wool Research Organisation of New Zealand (Inc.), Carpet Technical Information, Carpet Manufacture, Broadloom tufting, Part 1, 2002, Self published, NZ.
Ian Slattery Expert Report, Aug. 19, 2016.
Ian Slattery Rebuttal Expert Report, Sep. 19, 2016.
Jim Farmer Revised Expert Report, Sep. 26, 2016.
Yamacuchi Sangyo Co. Ltd., Design Tuft Tufting Machine, May 13, 2002, Self published, Japan.
Mecca, Five Stars Design Catalog, 1985, Egypt.
2002 Medallion Carpet, Expert Report of Ian Slattery dated Aug. 16, 2016, pg. 9, *Card-Monroe Corp.* v. *Tuftco Corp.*, E. D. Tenn., Case No. 1 :14-cv-292.
Silhouette Carpet from 2004, sold by Dixie Home, Expert Report of Ian Slattery dated Aug. 16, 2016, pg. 10, *Card-Monroe Corp.* v. *Tuftco Corp.*, ED. Tenn., Case No. 1:14-cv-292.
Green Multilevel Cut Loop (MLCL) Carpet, Expert Report of Ian Slattery dated Aug. 16, 2016, pg. 10, *Card-Monroe Corp.* v. *Tuftco Corp.*, Ed. Tenn., Case No. 1:14-cv-292.
1982 Egyptian carpet, produced by Mecca Carpets, Expert Report of Ian Slattery dated Aug. 16, 2016, pg. 10, *Card-Monroe Corp.* v. *Tuftco Corp.*, E.D. Tenn., Case No. 1:14-cv-292.
Thorn 2001 Carpet, Expert Report of Ian Slattery dated Aug. 16, 2016, pg. 11, *Card-Monroe Corp.* v. *Tuftco Corp.*, E.D. Tenn., Case No. 1:14-cv-292.
2004 Monkey Pattern, Expert Report of Ian Slattery dated Aug. 16, 2016, pg. 11, *Card-Monroe Corp.* v. *Tuftco Corp.*, E. D. Tenn., Case No. 1 :14-cv-292.
Sudderth, Letter dated Nov. 4, 2016, Atlanta, GA.
Sudderth, Letter dated Nov. 30, 2016, Atlanta, GA.

* cited by examiner

METHOD FOR SELECTIVE DISPLAY OF YARN IN A TUFTED FABRIC WITH DOUBLE END YARN DRIVES

The present application claims priority to U.S. Patent Application No. 61/750,755 filed Jan. 9, 2013.

FIELD OF THE INVENTION

The present invention relates to the operation of the tufting machines and is more particularly concerned with method for configuring and operating a tufting machine to economically produce a tufted fabric that displays selected yarns while concealing other yarns to produce novel carpet designs, without leaving long loops of unfastened yarns on the back of the greige.

BACKGROUND OF THE INVENTION

The tufting industry has long sought easy and efficient methods of producing new visual patterns on tufted fabrics. In particular, the industry has sought to tuft multiple colors so that any selected yarns of multiple colors could be made to appear in any desired location on the fabric. Significant progress toward the goal of creating carpets and tufted fabrics selectively displaying one of a plurality of yarns came with the introduction of a variety of servo motor driven yard feed attachments. Notable among these attachments are the servo scroll attachment described in Morgante, U.S. Pat. No. 6,224,203 and related patents; the single end servo scroll of Morgante, U.S. Pat. No. 6,439,141 and related patents; and the double end servo scroll of Frost, U.S. Pat. No. 6,550,407.

In operation the servo scroll yarn feed attachment, when alternating needles are threaded with A and B yarns respectively, allows the control of tufting of heights of yarns so that at a given location on the surface of the tufted fabric, either or both of the A and B yarns may be visible. However, a servo scroll yarn feed carries several yarns on each servo driven yarn feed roll so that the pattern must repeat several times across the width of the fabric and a yarn tube bank must be used to distribute the yarns. The implementation of the single end scroll pattern attachment, and the similar double end servo scroll pattern attachment, permitted the tufting machine to be configured with A and B yarns fed to alternating needles on a front needle bar while C and D yarns were fed to alternating needles on a rear needle bar in order to create color representations on tufted fabrics. The single end scroll yarn feed could create patterns that extended across the entire width of the backing fabric. However, in the full color application described above, these efforts suffered from the difficulty that if a solid area of one color was to be displayed, only one of every four stitches was tufted to substantial height and the remaining three colors were "buried" by tufting the corresponding yarn bights to an extremely low height. With only one of four stitches emerging to substantial height above the backing fabric, the resulting tufted fabric had inadequate face yarn for general acceptance.

The principal alternative to these servo yarn drive configurations has been the use of a pneumatic system to direct one of a plurality of yarns through a hollow needle on each stitch of tufting machine, as typified by U.S. Pat. No. 4,549,496. Such hollow needle, pneumatic tufting machines were traditionally most suitable for producing cut pile tufted fabrics and have been subject to limitations involving the sizes of fabrics that can be tufted, the production speed for those fabrics, and the maintenance of the tufting machines due to the mechanical complexity attendant to the machines' operation. Accordingly, the tufting industry has had a long felt need for a tufting machine that could operate efficiently to display one of several yarns at a selected location while maintaining a suitable density of yarns and operating at speeds approaching those of conventional tufting machines.

It should be noted that the pneumatic tufting machines utilizing hollow needles as in U.S. Pat. No. 4, 549,496 generally tuft laterally for between about one-half to four inches before backing fabric is advanced. Because the yarn being tufted is cut at least every time the color yarn being tufted through a particular needle is changed, there is no unnecessary yarn placed as back stitches on the bottom of the tufted fabric. However, when attempts have been made to utilize a regular tufting machine configuration with a needle bar carrying a transverse row of needles in a similar fashion, the yarns are not selected for tufting and cut after tufting, but instead each yarn is tufted in every reciprocal cycle of the needle bar. Therefore yarn carrying needles all penetrate the backing fabric on every cycle. The yarns are selected for display by a yarn pattern device feeding the yarn to be displayed and backrobbing the yarns that are not to be visible thereby burying the resulting yarn bights or tufts very close to the surface of the backing fabric. If several stitches are made as the needle bar moves laterally with respect to the backing fabric, then back stitch yarn for each of the colors of yarn is carried for each stitch and this results in considerable "waste" of yarn on the bottom of the resulting tufted fabric. Independently Controlled Needle (ICN) tufting machines typified by Kaju, Pat. No. 5,392,723 and related patents operate similarly, except the selection of the needles determines the yarns that will be displayed.

To overcome these difficulties, three methods of configurating and operating tufting machines of conventional design have been devised for the placement of color yarns.

In a first alternative, a pile fabric can be created selectively displaying one of three or more distinct yarns in the following fashion. Using the example of a thread-up featuring four yarns that have distinct colors, an inline needle bar, typically of about $1/10^{th}$ gauge is threaded with a repeat of A, B, C, D over every four needles. The tufting machine is programmed to tuft four stitches laterally before advancing the backing fabric. In this fashion, each of the four adjacent needles threaded with yarns A, B, C, and D respectively will penetrate the backing fabric at nearly the same position. On those four cycles of the needles penetrating the backing fabric, adequate yarn will be fed by the associated servo motor for the color that is desired to predominate visually in that location. Sufficient yarn is fed to allow the yarn bight of the desired color to be tufted at a relatively high level. The other yarns are backrobbed in order to bury their associated yarn bights at a relatively low level. After tufting the four lateral cycles, the backing fabric is advanced and the four lateral stitch cycle is repeated with the needle bar moving in the opposite direction. It can be seen that this method, although functional, results in excess yarn on the bottom of the tufted fabric compared to ordinary tufted fabrics, and requires that the tufting machine operate only at about one-fourth the speed that it would operate if tufting conventional fabric designs. This technique was described in U.S. Pat. No. 8,141,505 to Hall, and will be discussed in further detail below.

In a second alternative it is possible to create a similar color placement effect in a cut/loop pile fabric utilizing the level cut loop configuration of U.S. Pat. No. 7,222,576 tufted on a tufting machine having about a $1/10^{th}$ gauge needle bar with a four color repeating thread-up. The tufting machine is operated to tuft laterally four times and allows the color chosen for display to be either a cut or loop bight while backrobbing the yarn colors not to be shown on the face of the carpet, and leaving only very low tufts of those yarns. Obviously, three or more than four different yarns may be used in the thread-up with a corresponding adjustment in the number of lateral shifts. In this method of operation, there is again considerable excess yarn carried on the bottom of the backing fabric.

Both the first and second alternatives are essentially the same techniques that have been utilized with two colors of yarn on a widespread basis in the tufting industry in past years. Although multiple cycles of lateral shifting presents some issues not present when shifting only a single lateral step, the principal issue is one of avoiding overtufting or sewing exactly in the same puncture of the backing fabric made by a previous cycle of a nearby needle. This is typically addressed by using one or both of positive stitch placement and continuous, but reduced speed, backing fabric feed.

An additional problem presented by the first and second alternative techniques is the sheer number of penetrations of the backing fabric which results in degradation or slicing of nonwoven backing fabric materials that are commonly utilized in the manufacture of tufted fabrics for carpet tiles and special applications such as automotive carpets.

Finally, to overcome these shortcomings, a third alternative to produce similar fabrics with yarn placement has been achieved with a staggered needle configuration having front and rear rows of needles offset or staggered from one another. A staggered needle bar typically consists of two rows of needles extending transversely across the tufting machine. The rows of needles are generally spaced 0.25 inches apart in the longitudinal direction and are offset so that the needles in the rear transverse row are longitudinally spaced between the needles in the front transverse row. Alternatively, two sliding needle bars each carrying a single transverse row of needles may be configured in a staggered alignment.

In operation the needle bar is reciprocated so that the needles penetrate and insert loops of yarn in a backing material fed longitudinally beneath the needles. The loops of yarn are seized by loopers or hooks moving in timed relationship with the needles beneath the fabric. In most tufting machines with two rows of needles, there are front loopers which cooperate with the front needles and rear loopers which cooperate with the rear needles. In a loop pile machine, it may be possible to have two separate rows of loopers such as those illustrated in U.S. Pat. No. 4,841,886 where loopers in the front hook bar cooperate with the front needles and loopers in the rear hook bar cooperate with rear needles. Similar looper constructions have been used in tufting machines with separate independently shiftable front and rear needle bars, so that there are specifically designated front loopers to cooperate with front needles and specifically designated rear loopers to cooperate with rear needles. To achieve maximum stitch density, and to minimize the possibility of tufting front and rear needles through the same penetrations of the backing fabric, it is desirable to offset the front loopers from the rear loopers by a half gauge unit.

The result of having loopers co-operable with only a given row of needles on a fine gauge tufting machine with two independently shiftable needle bars is that it is only possible to move a particular needle laterally by a multiple of the gauge of the needles on the relevant needle bar. Thus for a fairly common 0.20 inch ($1/5^{th}$) gauge row of needles with corresponding loopers set at 0.20 inch gauge, the needles must be shifted in increments of 0.20 inches. This is so even though in a staggered needle bar with two rows of 0.20 inch gauge needles the composite gauge of the staggered needle bar is 0.10 inch gauge. The necessity of shifting the rows of needles twice the gauge of the composite needle assembly results in patterns with less definition than could be obtained if it were possible to shift in increments of the composite gauge.

One effort to reduce the gauge of tufting has been to use smaller and more precise parts. Furthermore, in order to overcome the problem of double gauge shifting, U.S. Pat. No. 5,224,434 teaches a tufting machine with front loopers spaced equal to the composite gauge and rear loopers spaced equal to the composite gauge. Thus on a tufting machine with two rows of 0.20 inch gauge needles there would be a row of front loopers spaced at 0.10 inch gauge and a row of rear loopers spaced at 0.10 inch gauge. Although this allows the shifting of each row of needles in increments equal to the composite gauge, this solution was limited in that the front needles can only be used to create loop pile and the rear needles can only be used to create cut pile.

Taking the arrangement of staggered needle bars shiftable at a composite gauge, and threading front needles with A and B yarns and rear needles with C and D yarns to form a repeat, a high volume of tufted fabric with selectively placed colored yarns can be manufactured with minimal wasted yarn used in the back stitching. This is because it is only necessary to shift each row of needles by a single lateral step in order to place all four A, B, C and D yarns in the desired location as described in U.S. Pat. No. 8,240,263. A principal disadvantage to this tufting arrangement and operation is the requirement for the use of twice as many needles and twice as many single end yarn drives as would be the case with slower and less efficient tufting arrangements for the selective placement of individual yarns. This results in increased cost and complexity of the tufting machine. Accordingly, improved methods of tufting machine operation to accomplish yarn color placement are still needed.

SUMMARY OF THE INVENTION

The present invention is addressed to techniques allowing a tufting machine to be threaded with four, six, or possibly even more colors of yarn, and to display selected colors at any location on the face of the carpet, while burying other yarn colors, maintaining adequate face yarn density, and minimizing the tacking stitches necessary to hold loose yarns on the back of the backing fabric. Furthermore, such fabrics can be tufted on a tufting machine of conventional design and configuration so that the cost of the tufting machine is not prohibitive and the machine can also be used in the manufacture of many pre-existing fabric patterns.

BRIEF DESCRIPTION OF THE DRAWINGS

Particular features and advantages of the present invitation will become apparent from the following description when considered in conjunction with the accompanying drawings in which.

DETAILED DESCRIPTION OF THE INVENTION

Figure 1:
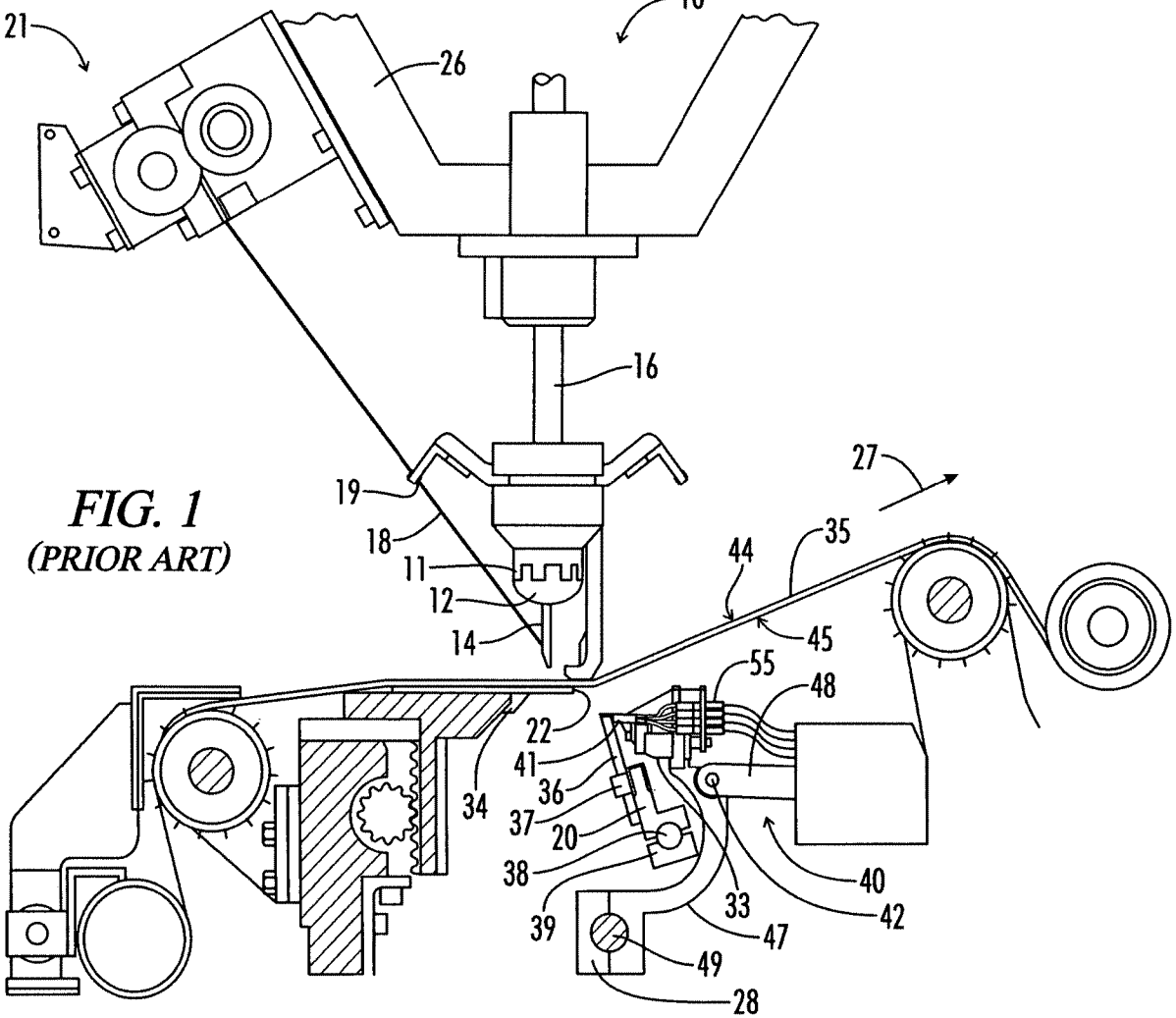
FIG. 1 (PRIOR ART)
FIG. 1 is a partial sectional end view of a prior art tufting machine that can be operated to place colored yarns in the manufacture of fabrics with cut and loop face yarns.

Referring now to the drawings in more detail, FIG. 1 discloses a multiple needle tufting machine 10 including an elongated transverse needle bar carrier 11 supporting a needle bar 12. The needle bar 12 supports a row of transversely spaced needles 14. The needle bar carrier 11 is connected to a plurality of push rods 16 adapted to be vertically reciprocated by conventional needle drive mechanism, not shown, within the upper housing 26.

Yarns 18 are supplied to the corresponding needles 14 through corresponding apertures in the yarn guide plate 19 from a yarn supply, not shown, such as yarn feed rolls, beams, creels, or other known yarn supply means, preferably passing through pattern yarn feed control 21. The yarn feed control 21 interfaces with a controller to feed yarns in accordance with pattern information and in synchronization with the needle drive, shifters, yarn seizing/cutting mechanisms and backing fabric feed.

The needle bar 12 may be fixedly mounted to the needle bar carrier 11 or may slide within the needle bar carrier 11 for transverse or lateral shifting movement by appropriate pattern control needle shifter mechanisms, in well known manners. The backing fabric 35 is supported upon the needle plate 34 having rearward projecting transversely spaced front needle plate fingers 26, the fabric 35 being adopted for longitudinal movement from front-to-rear in a feeding direction, indicated by the arrow 27, through the tufting machine 10.

The needle drive mechanism, not shown, is designed to actuate the push rods 16 to vertically reciprocate the needle bar 12 to cause the needles 14 to simultaneously penetrate the backing fabric 35 far enough to carry the respective yarns 18 through the backing fabric 35 to form loops on the face thereof. After the loops are formed, the needles 14 are vertically withdrawn to their elevated, retracted positions. A yarn seizing apparatus 40 in accordance in this illustration includes a plurality of gated hooks 41, there preferably being at least one gated hook 41 for each needle 14.

Each gated hook 41 is provided with a shank received in a corresponding slot in a hook bar 33 in a conventional manner. The gated hooks 41 may have the same transverse spacing or gauge as the needles 14 and are arranged so that the bill of a hook 42 is adapted to cross and engage with each corresponding needle 14 when the needle 14 is in its lower most position. Gated hooks 41 operate to seize the yarn 18 and form a loop therein when the sliding gate is closed by an associated pneumatic cylinder 55, and to shed the loop as the gated hooks 41 are rocked.

The elongated, transverse hook bar 33 and associated pneumatic assembly are mounted on the upper end portion of a C-shaped rocker arm 47. The lower end of the rocker arm 47 is fixed by a clamp bracket 28 to a transverse shaft 49. The upper portion of the rocker arm 47 is connected by a pivot pin 42 to a link bar 48, the opposite end of which is connected to be driven or reciprocally rotated by conventional looper drive. Adapted to cooperate with each hook 41 is a knife 36 supported in a knife holder 37 fixed to knife block 20. The knife blocks 20 are fixed by brackets 39 to the knife shaft 38 adapted to be reciprocally rotated in timed relationship with the driven rocker arm 47 in a conventional manner. Each knife 36 is adapted to cut loops formed by each needle 14 upon the bill of the hook 41 from the yarn 18 when gates are retracted and yarn loops are received on the hooks 41. A preferred gated hook assembly is disclosed in U.S. Pat. No. 7,222,576 which is incorporated herein by reference. When a tufting machine of this type is threaded with A,B,C, and D yarns repeating every four needles, it is suitable to manufacture tufted fabric according to the second alternative described above in the Background of the Invention.

In order to reduce the likelihood of needles from one cycle of tufting entering the exact same openings that were tufted on a previous cycle, a technique referred to in the tufting industry as "positive stitch placement" may be utilized. In this procedure, the needles are shifted slightly out of line with their associated loopers and the needles begin their downward path until engaging in the backing fabric. Once engaged in the backing fabric, the needles are moved by a shifting apparatus into their proper alignment with associated loopers and the needles continue their downward path carrying yarns through the backing fabric and the yarns are seized by the loopers. Cam shifters, roller screw shifters, and hydraulic shifters may be used for this purpose.

An additional technique that may minimize the lateral yarns on the backstitch side of the tufted fabric involves backrobbing yarns that are not intended to be displayed. Such yarns are already tufted with relatively low yarn tufts so that the low tufts are concealed by relatively higher tufts of the yarns that are intended to be displayed. If the yarn for these low tufts is backrobbed to the extent that there is no tuft bind and the yarn lays flat across the backing fabric, the yarn used between visible stitches is reduced. So long as the yarn is periodically left penetrating the backing fabric, at most about every tenth to twelfth stitch but more preferably about every fourth or fifth stitch (and even as frequently as every alternate stitch), the yarn used to carry "buried" yarns from one display location to another may be reduced.

However, if yarns are not controlled so that they can be tacked periodically by tufting a buried or visible stitch, then loose segments of yarn on the backing present two problems for further processing of the greige. First, the loose yarn segments form loops hanging from the backing that can be snagged on equipment as the greige is being processed and this can both foul equipment and pull stitches from the face of the tufted greige, ruining its appearance. Second, the bunching of loose yarns on the backing can interfere with the finishing process as it may require substantially larger amounts of latex coating and result in irregular attachment of the secondary backing. Larger amounts of latex are not only more costly, but also add weight to the carpet and require additional time and heat to cure after application.

Figure 2A:
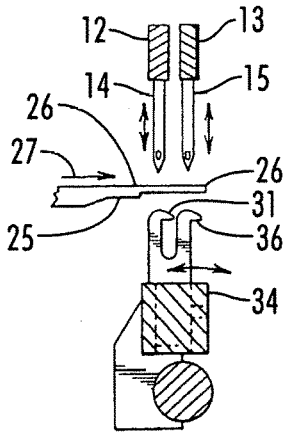
FIG. 2A (PRIOR ART)
FIG. 2A is a side elevation view of a second prior art needle and looper assembly for making loop pile carpet with two transverse rows of longitudinally offset needles.
Figure 3:
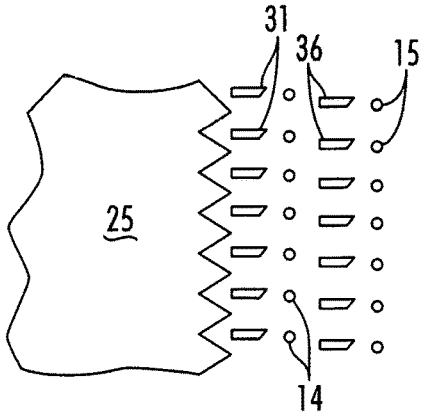
FIG. 3 is a top sectional view of a fine gauge needle and looper arrangement with the needles and loopers of each row slightly staggered from one another.

In FIG. 2A, a prior art loop pile tufting machine is shown with front needle bar 12 supporting front needles 14 and rear needle bar 13 supporting rear needles 15 in an upper position. Backing fabric, not shown, is fed over a needle plate 25 in direction 27 and is supported by needle plate fingers 26 in the area where needles 14 and 15 penetrate the backing fabric. When needles 14 and 15 are driven downward into a lower position by conventional means to penetrate the backing fabric, the front loopers 31 and rear loopers 36 mounted in looper bar 34 are reciprocated to cross front needles 14 and rear needles 15 respectively.

Figure 2B:
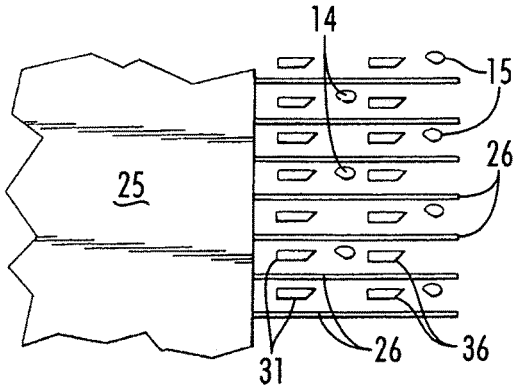
FIG. 2B (PRIOR ART)
FIG. 2B is a top sectional view of the prior art needle and looper assembly of FIG. 2A, showing the offset needles and the hooks positioned at the composite needle gauge.

The looper bar 34 is reciprocated by conventional means, not shown, acting on a rocker shaft, so that loopers 31 and 36 seize and release loops of yarn thereby forming loop pile tufts on the bottom surface of the backing fabric. FIG. 2B shows the arrangements of needles 14 and 15, and loopers 31 and 36 from a top view. It will be seen that the front and rear loopers 31 and 36 are in line, but the needles may shift in single gauge units. By way of example, the illustrated front needles 14 may be spaced at $1/5^{th}$ gauge and the loopers 31 are therefore spaced at $1/10^{th}$ gauge. In this example, the front needles 14 may be shifted in $1/10^{th}$ gauge increments. A disadvantage to this particular arrangement is that the front and rear gauge positions are directly in line. This may cause over sewing where front and rear yarns are tufted in the same openings in the backing material, resulting in an irregular appearance of yarns on the face. The configuration of FIG. 6 where the loopers 31, 36 are slightly offset transversely can address this concern.

Figure 4:
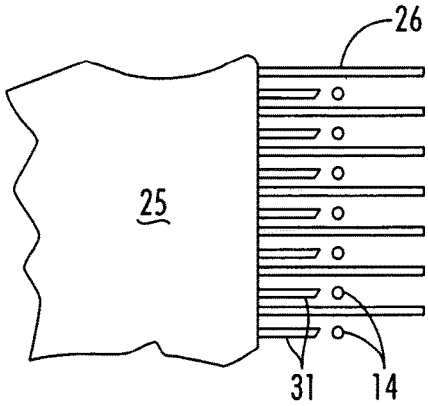
FIG. 4 is a top sectional view of a single row of needles and loopers.
Figure 5A:
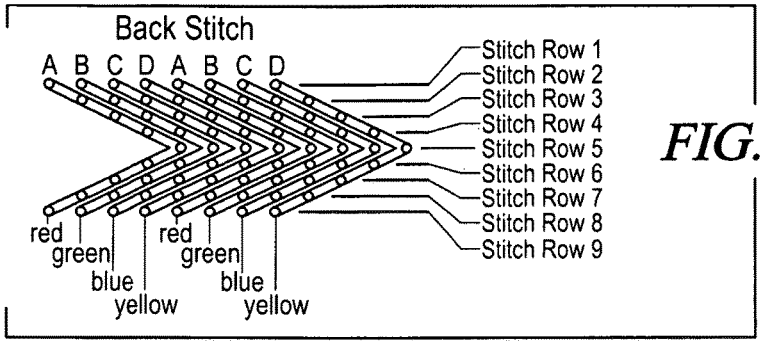
FIG. 5A is a schematic illustration of the back stitching on a backing fabric tufted by moving a needle bar with an A, B, C, D thread-up laterally for four stitches.
Figure 5B:
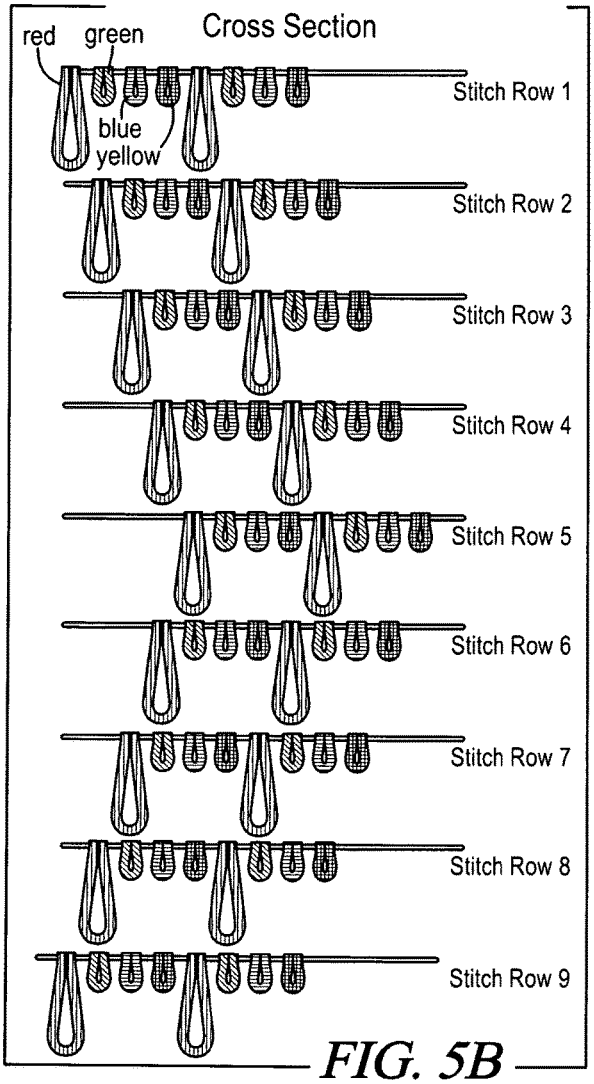
FIG. 5B is a sectional view of the fabric of FIG.5A, with red yarns tufted high and green, blue and yellow yarns tufted low.
Figure 5C:
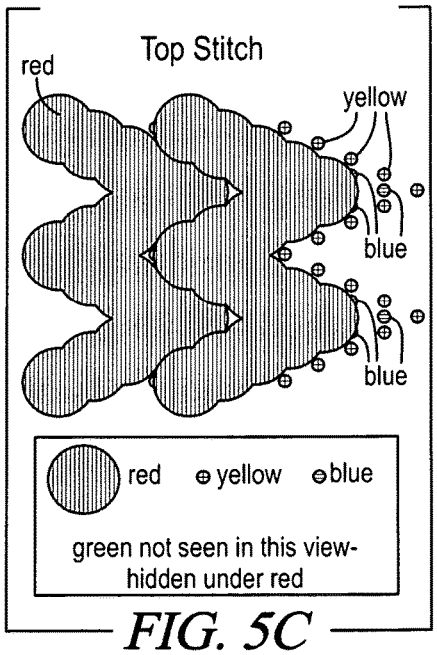
FIG. 5C is a schematic illustration of the face of the fabric of FIG. 5A.

FIG. 4 is a top view of a needle bar with a single row of needles 14 associated with loopers 31 and where a backing fabric, not shown, would pass over needle plate 25 and needle plate fingers 26 for tufting. To create a carpet with more than two colors of yarn and a sufficient stitch density when all but one of the colors is buried, a single row of needles 14 as illustrated in FIG. 4, must generally be tufted laterally in at least three steps or four steps as represented in the backstitch illustration of FIG. 5A. Thus, if carpet were being tufted with eight longitudinal rows of stitches per inch, this method of tufting requires that the single needle bar threaded with A, B, C, and D yarns be tufted through at least four cycles as the backing fabric advances $1/8^{th}$ of an inch. Although the backing fabric could be halted for the four stitches and then indexed to advance an eighth of an inch, it is generally preferred to keep the backing advancing but at a reduced speed. This helps minimize the possibility of oversewing. Next the shifting of the needle bar is reversed for the following four cycles of tufting while the backing fabric is again advanced another $1/8^{th}$ of an inch. This technique produces sufficient stitch density to provide good coverage of the face of the fabric by a single yarn color as illustrated in top stitch view of the face of the resulting fabric in FIG. 5C. FIG. 5B shows a cross section of each row of stitches. The illustrated nine rows of stitches have to be longitudinally compressed to fit in a space where ordinarily only slightly more than two rows of stitches would otherwise be placed.

This single row of needles yarn thread up also benefits from the use of positive stitch placement and the backrobbing of yarns on at least selected stitches from the colors of yarn that are not intended to be displayed on the face of the carpet as described above. However, use of this technique to produce four color tufted fabrics with solid areas of color suffers drawbacks. For instance, tufting of fabric is slow due to the necessity to shift the needle bar laterally four times before advancing the length of a full row of stitches. In addition, the close penetrations of the needles will slice some nonwoven backing fabrics that are desirable for use in carpet tile and other special applications. Finally, the backstitching consumes a substantial quantity of yarn as the three yarns that are buried on each stitch are carried back and forth laterally.

Accordingly, arrangement of front loopers 31 and front needles 14 offset by a half gauge from rear loopers 36 and rear needles 15, as described in U.S. Pat. No. 8,240,263. is most desirable, as it is possible to tuft a four color yarn threadup at much greater speeds than using a single needle bar and much less yarn is wasted on the bottom of the backing fabric with lateral stitching.

However, this speed and efficiency requires a very costly tufting machine with pattern control yarn feeds and associated yarn creels on each side of the tufting machine to feed front and rear needles. The number of needles required, and assorted yarn feed rolls, is twice that required for traditional tufting set ups. Therefore, a $1/10^{th}$ gauge fabric will have 20 needles per inch (ten on each of the front and rear rows of needles).

Figure 6A:
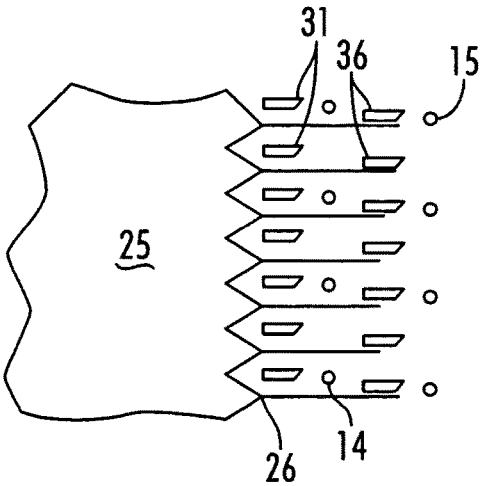
FIG. 6A is a top sectional view of a needle and looper arrangement with two rows of slightly staggered needles having associated loopers spaced at half the gauge of the needles.
Figure 6B:
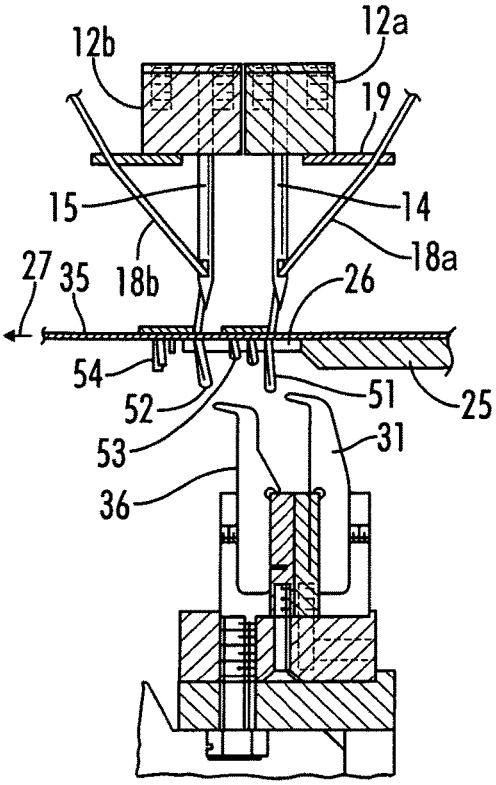
FIG. 6B is a reverse angle side elevational view of the needle and looper assembly of FIG. 6A that is threaded up and tufting stitches.

Turning then to FIG. 6A, a 1/5th gauge fine line needle and looper arrangement is shown with front needles 14 rear needles 15 each longitudinally spaced at $1/5^{th}$ inch increments. Front loopers 31 and rear loopers 36 are spaced at $1/10^{th}$ gauge increments so that the needles 14 in front row or needles 15 in rear row can be shifted laterally in $1/10^{th}$ gauge steps. Variations of the $1/5^{th}$ gauge needle spacing and $1/10^{th}$ gauge looper spacing are also possible such as $1/6^{th}$ gauge needle spacing and $1/12^{th}$ gauge looper spacing or even $1/4^{th}$ gauge needle spacing and $1/8^{th}$ gauge looper spacing for bulkier yarns. Typically, as reflected in FIG. 6B, the front row of needles 13 is one half inch forward of the rear row of needles 15. For this reason, in order to synchronize the tufting of a pattern, the front needles in a $1/5^{th}$ gauge- four color setup will sew the first stitch of a pattern while the rear needles 15 sew the twenty-first stitch of that pattern. Such a setup will tuft forty reciprocal penetrations of the backing fabric per inch for each needle bar. The calculation of the stitch offset compensation can be computed by multiplying the number of needles per inch by the number of colors threaded on the needles. So for four colors on $1/5^{th}$ gauge needles, the offset is twenty stitches and the front needles sew stitch one from the pattern while the rear needles sew stitch twenty-one. In a setup with $1/6^{th}$ gauge needle spacing and six colors, the offset would be thirty-six stitches and the front needles 14 sew stitch one while the rear needles 15 sew the thirty-seventh stitch in the pattern. FIG. 6B shows current yarn loops 51,52 being formed by needles 14,15 as they penetrate the backing fabric 35 where the loops can be seized by loopers 31,36. After the loops are formed, they can be backrobbed to a lower height as loops 53,54 or even bockrobbed to completely remove the loop from penetrating the backing fabric. The most precise yarn feed can even leave the backrobbed loops to remain within the thickness of the backing fabric so that the loops either do not fully penetrate the fabric or penetrate the fabric insubstantially.

Figure 7A:
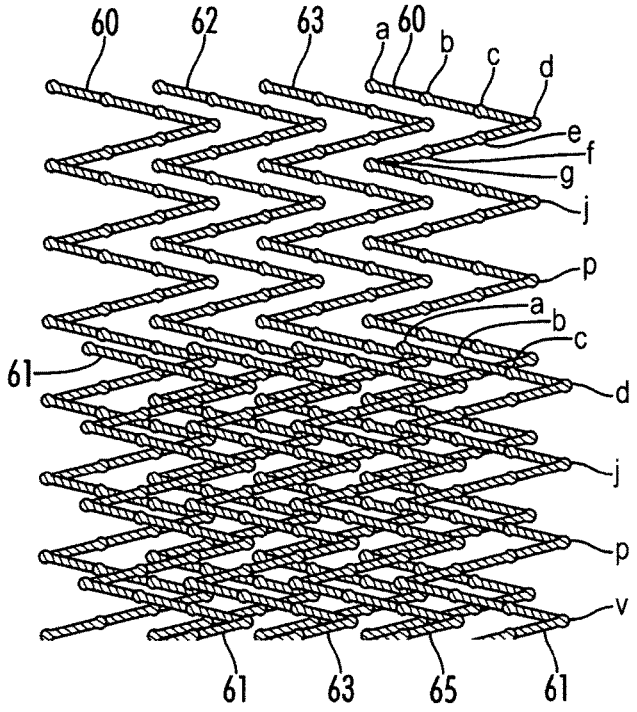
FIG. 7A illustrates a set of stitches made by two shiftable needle bars as in FIG. 6 that are operated without offset stitching compensation.
Figure 7B:
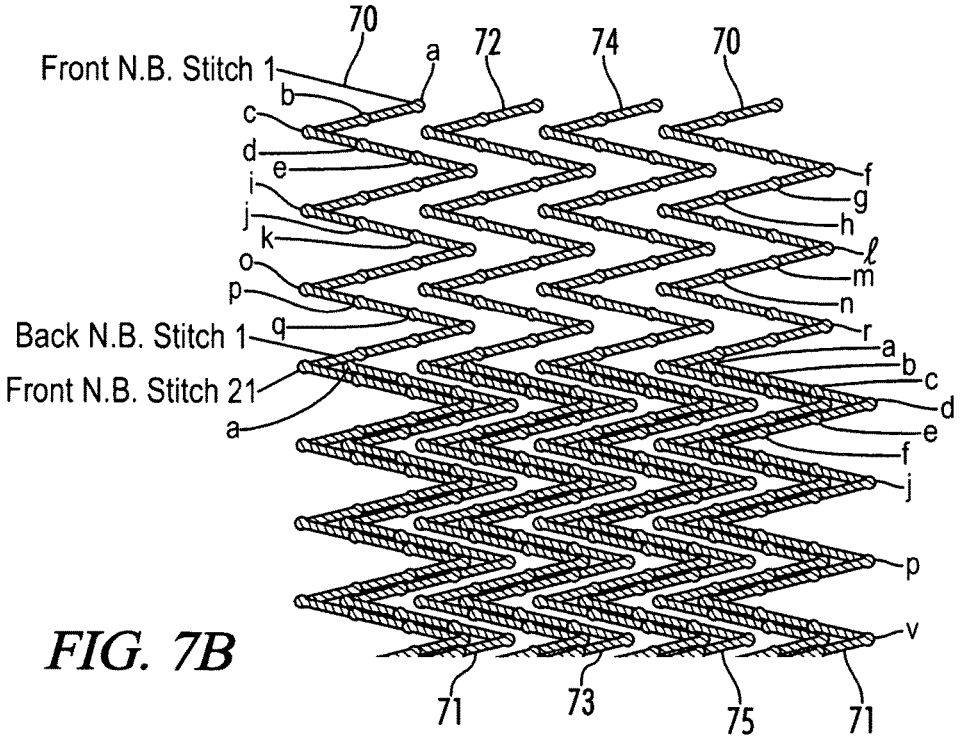
FIG. 7B illustrates stitches made by two shiftable needle bars as in FIG. 6 that are operated with offset stitching compensation.

FIG. 7A demonstrates the difference in proper stitch offset calculations where front yarns 60, 62 and 64 and rear yarns 61, 63 and 65 both are sewing the first stitch of the pattern at the outset. Thus, first front needle stitch 60*a* is very nearly longitudinally aligned with first rear stitch 61*a*, however, as the pattern progresses and the stitches tufted with front yarns 60, 62 and 64 are overtufted by rear yarns 61, 63 and 65 it can be seen that there is not a uniform density of stitch locations and there may be resulting gaps in coverage of the backing fabric. On the other hand, with a twenty stitch offset as shown in FIG. 7B, after twenty stitches the rear yarns 71, 73 and 75 align perfectly with the front yarns 70, 72 and 74, and if not for the additional spacing between pairs of yarns for clarity it could be seen that there would be comprehensive coverage of the backing fabric by the backstitching. FIGS. 7A and 7B depict the arrangement of three yarns on each of the front and rear rows of needles so that sequential stitching in each direction is only three reciprocal penetrations of the backing.

Of course, the back stitch created in FIG. 7B has the same appearance as the back stitch created with a single row of needles having only half the gauge spacing. Thus, the two $\frac{1}{5}^{th}$ gauge rows of needles produce a backing having the same appearance as a single row of $\frac{1}{10}^{th}$ gauge spaced needles. If each stitch of yarn penetrates the backing fabric and is not backrobbed, the resulting carpet is effectively identical.

However, as previously mentioned, it is desirable not to leave buried stitches in the backing on every stitch in order to minimize the use of yarn. Yet, it is also desirable to have occasional buried stitches to prevent loose yarns from forming on the back of the greige that could become entangled or complicate the application of latex or other backing material.

A surprising advantage of the dual front and rear needle bar solution illustrated in FIG. 6 is that the yarns from the rear needle bar will overtuft the yarns from the front needle bar. This obviates the need for any tacking stitches to be made with the front yarns as the rear yarns overtufting the front yarns on the backing eliminates the problem of loose front yarns. Only occasional tacking stitches need to be made with the rear yarns.

This advantage can be demonstrated in FIGS. 8A through 8G. In these figures, four colors of front yarns 81,82,83,84 are threaded on the front needles 14 and four colors 91,92, 93,94 are threaded on the rear needles 15. As with FIG. 7, the stitches for each yarn are designated by sequentially increasing letters a, b, c, etc. Thus, the first stitch shows a first rear yarn 91 being tufted at point 91*a* and a first front yarn 81 being tufted at point 81*a*. As the first four stitches are made in the pattern, it can be seen that rear yarns 91 and 93 are forming tufts so that the stitches at positions 91*b*, 91*c*,91*d* and 91*e* are all fixed by loops penetrating the backing fabric, as are the stitches at positions 93*b*,93*c*,93*d* and 93*e*. On the other hand, the front yarns 81-84 and two rear yarns 92 and 94 are not forming tufts in the backing and so are not fixed to the backing at any point other than the first stitch locations a.

Figure 8A:
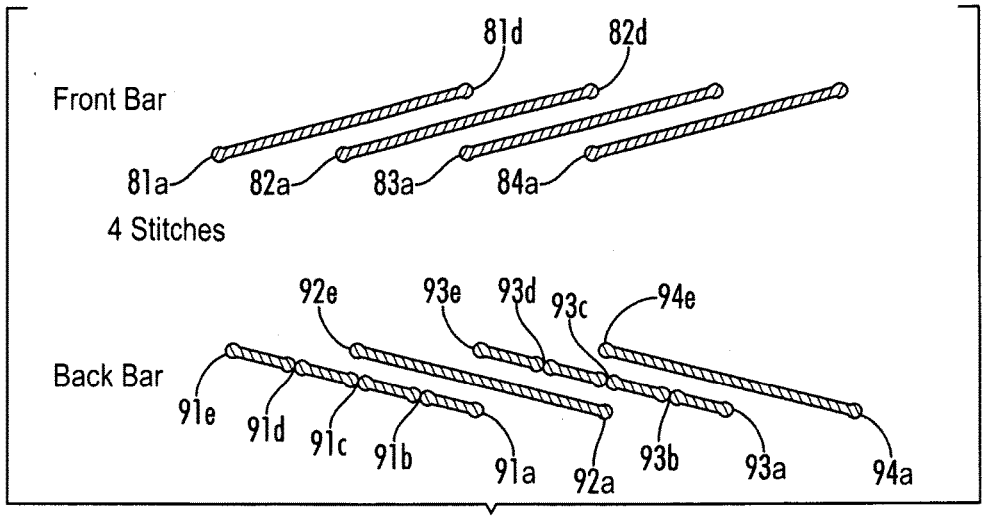
FIG. 8A represents the tufting of four stitches by front and back needle bars with pattern offset stitch compensation.
Figure 8B:
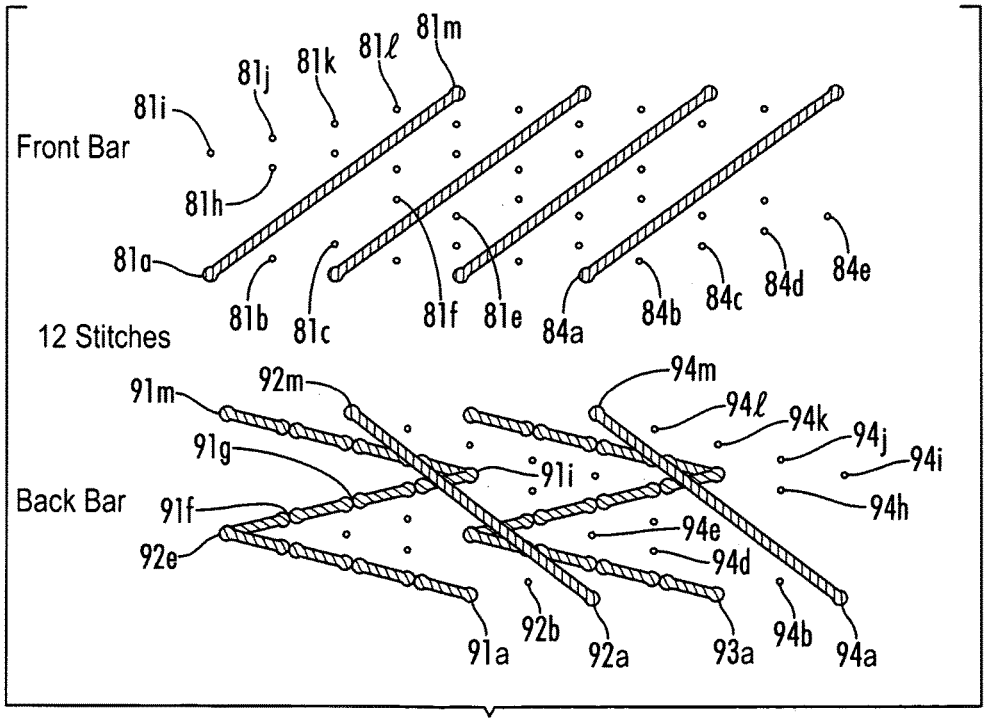
FIG. 8B depicts the tufting of FIG. 8A extended to twenty stitches.
Figure 8C:
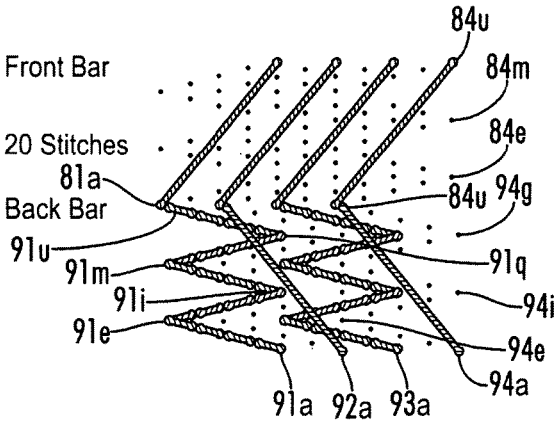
FIG. 8C depicts the tufting of FIG. 8A extended to twenty stitches.

FIG. 8B shows the pattern as it has progressed through twelve stitches so that now the yarns that are being tufted to penetrate and form tufts on the face of the fabric, 91 and 93, have created Z-shaped patterns while the remaining yarns that are being backrobbed so as not to form tufts in the backing fabric continue to be unfixed to the backing material other than the first stitch locations a. FIG. 8C shows the pattern after twenty stitches have been completed so that the first stitches a of front yarns 81-84 are aligned with the twenty-first stitches u of the rear yarns 91-94. Again, only yarns 91 and 93 are creating tufts on the face of the fabric so that the remaining yarns 81-84,92,94 are not fixed other than the first stitch locations a.

Figure 8D:
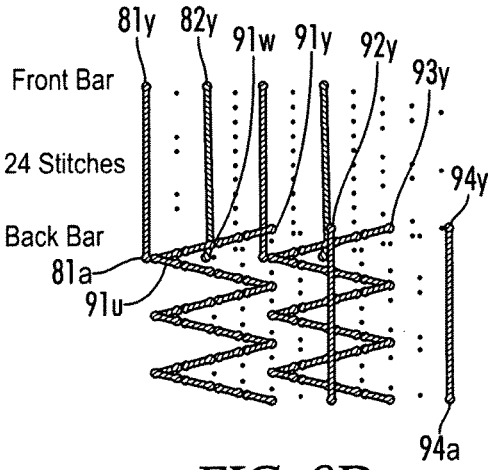
FIG. 8D depicts the tufting of FIG. 8A extended to twenty-four stitches.
Figure 8E:
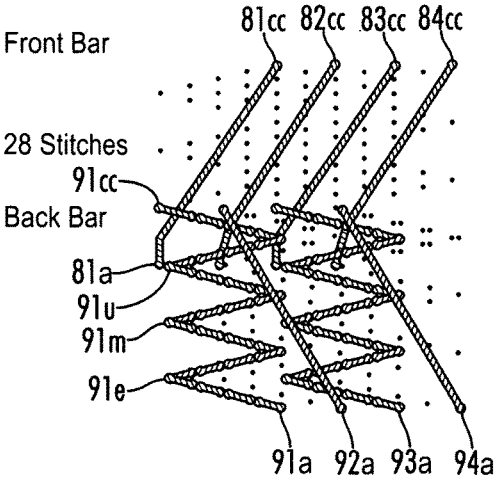
FIG. 8E depicts the tufting of FIG. 8A extended to twenty-eight stitches.
Figure 8F:
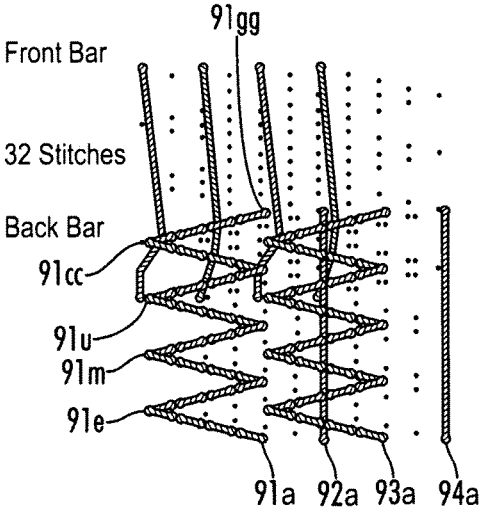
FIG. 8F depicts the tufting of FIG. 8A extended to thirty-two stitches.

As the pattern proceeds from stitch 20 to stitch 24 in FIG. 8D, it can be seen that rear yarns 91 and 93 begin to overtuft front yarns 82,84. This overtufting results in tacking front yarns 82,84 into place so that they are no longer loose and unsupported from their original stitch locations a. As the pattern proceeds in FIGS. 8E and 8F to the twenty-eighth and thirty-second stitches, it can be seen that all of the front yarns 81-84 are overtufted by rear yarns 91,93 and now only the rear yarns 92,94 that have not been forming tufts on the face of the carpet are unattached.

Figure 8G:
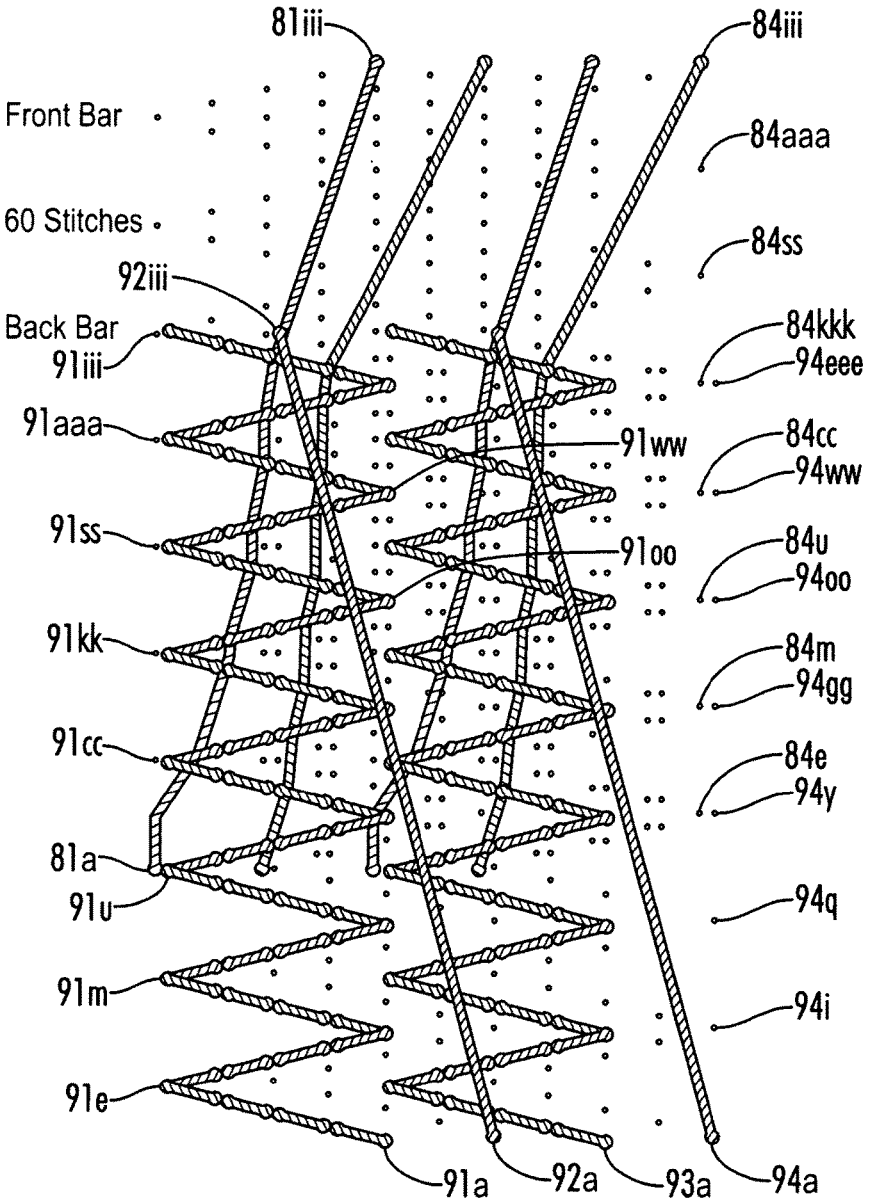
FIG. 8G depicts the tufting of FIG. 8A extended to sixty stitches.

In FIG. 8G, the pattern has proceeded for sixty stitches and a number of the perforations created by yarns that were backrobbed from the backing fabric have been identified for ease of reference where it can be seen that the right most stitches created by the right most rear yarn are designated 94*a*, 94*i*, 94*q*, 94*y*, 94*gg*, 94*oo*, 94*ww*, and 94*eee*. Similarly, it can be seen that the left most stitches of the left most rear yarn are designated 91*e*, 91*m*, 91*u*, 91*cc*, 91*kk*, 91*ss*, 91*aaa*, and 91*iii*. The tufting of yarns 91 and 93 have overtufted the front yarns 81-84 and those yarns present no dangling looping hazards or backing difficulties. On the other hand, rear yarns 92,94 that have not been tufted are free for a length of sixty stitches and this would create a generally unacceptable amount of free yarn on the backing. To avoid this eventuality, such rear yarns would generally be tufted every two to twelve stitches, or four to six stitches, with a buried loop on the face of the carpet adequate to fix the rear yarn in place and avoid free rear yarn on the back of the greige and even further assist in tacking down front yarns.

The yarn feed devices that can be utilized in this configuration are comparable to the yarn feeds that would be used in the case of color selection practiced with a single row of needles. So, for a 12 foot wide tufting machine with a single row of needles sewing at $10^{th}$ gauge, there would be 1200 needles, and 1200 yarn drives would be required to provide for single end yarn control and no pattern repeats across the width of the machine. With the configuration of FIG. 6A, there would be two rows of $\frac{1}{5}^{th}$ gauge needles, and thus 600 needles in each of the front and rear lateral rows of needles. Yarns can be supplied to these needles by a front yarn feed control device with an array of 600 single end yarn drives and a rear yarn feed control device with an array of 600 single end yarn drives—again a total of 1200 yarn drives. Thus an equivalent tufting machine is capable of producing tufted carpet with substantially identical patterns on the face of the carpet and with significantly improved backstitch structure, minimizing loose yarns without significant additional stitching and thereby achieving some yarn savings.

All publications, patent, and patent documents mentioned herein are incorporated by reference herein as though individually incorporated by reference. Numerous alterations of the structure herein disclosed will suggest themselves to those skilled in the art. However, it is to be understood that the present disclosure relates to the preferred embodiments of the invention which is for purposes of illustration only and not to be construed as a limitation of the invention. All such modifications which do not depart from the spirit of the invention are intended to be included within the scope of the appended claims.

We claim:

1. A method of operating a tufting machine of the type having front and rear rows of spaced needles disposed transversely across the width of the machine, a pattern yarn feed control for supplying yarns to the needles, a needle bar shifter for shifting for the transverse rows of needles, loopers operable to seize yarns from the needles, a control system for providing pattern information to the pattern yarn feed control mechanism and the needle bar shifter comprising the steps of:

threading the front and rear transverse rows of needles with a plurality of different yarns forming a repeat;

feeding a backing fabric through the tufting machine and reciprocating the front and rear transverse rows of needles to cause the plurality of yarns to penetrate the backing fabric;

seizing the yarns penetrating the backing fabric with loopers;

laterally shifting the front and rear transverse rows of needles;

controlling the feeding of yarns to the transverse rows of needles in accordance with the pattern information and in accordance with a pattern stitch offset between the front and rear rows of needles to form relatively high tufts of yarns to be displayed and relatively low tufts of yarns to be hidden;

wherein the backing fabric is advanced by approximately one-fourth length of the composite gauge of the two rows of needles for each reciprocation of the needles when the needles are threaded with four colors of yarn.

2. A method of operating a tufting machine of the type having front and rear rows of spaced needles disposed transversely across the width of the machine, a pattern yarn feed control for supplying yarns to the needles, a needle bar shifter for shifting for the transverse rows of needles, loopers operable to seize yarns from the needles, a control system for providing pattern information to the pattern yarn feed control mechanism and the needle bar shifter comprising the steps of:

threading the front and rear transverse rows of needles with a plurality of different yarns forming a repeat;

feeding a backing fabric through the tufting machine and reciprocating the front and rear transverse rows of needles to cause the plurality of yarns to penetrate the backing fabric;

seizing the yarns penetrating the backing fabric with loopers;

laterally shifting the front and rear transverse rows of needles;

controlling the feeding of yarns to the transverse rows of needles in accordance with the pattern information and in accordance with a pattern stitch offset between the front and rear rows of needles to form relatively high tufts of yarns to be displayed and relatively low tufts of yarns to be hidden; wherein front loopers seize yarns from the front row of needles and rear loopers seize yarns from the rear row of needles and rear yarns overtuft front yarns and the front loopers and the rear loopers are staggered with respect to each other.

3. A method of tufting a patterned fabric from a plurality of colored yarns on a tufting machine comprising the steps of:

(a) providing a tufting machine with pattern information;

(b) threading a first plurality of yarns through a yarn feed pattern control device to a front row of needles, said needles of the front row being transversely spaced apart from one another by a gauge distance and the first plurality of yarns being distributed to the needles in a first repeating color sequence;

(c) threading a second plurality of yarns through a yarn feed pattern control device to a rear row of needles, said needles of the rear row being transversely spaced apart from one another by the gauge distance and the second plurality of yarns being distributed to the needles in a second repeating color sequence;

(d) feeding a backing fabric longitudinally through the tufting machine from front to back;

(e) reciprocating the front and rear rows of needles to penetrate the backing fabric to thereby carrying loops of the first and second pluralities of yarns from a back side of the backing fabric to a face side of the backing fabric;

(f) operating loopers on the face side of the backing fabric to seize loops of the first and second pluralities of yarns;

(g) operating the yarn feed pattern control device in accordance with the pattern information and a pattern stitch offset to form relatively high loops and relatively low loops from the first and second pluralities of yarns such that the relatively high loops are displayed and relatively low loops are at least partially concealed;

wherein at least one yarn from each adjacent first repeating color sequence and second repeating color sequence is displayed from each reciprocation of the needles and the backing fabric is a nonwoven fabric.

4. A method of tufting a patterned fabric from a plurality of colored yarns on a tufting machine comprising the steps of:

(a) providing a tufting machine with pattern information;

(b) threading a first plurality of yarns through a yarn feed pattern control device to a front row of needles, said needles of the front row being transversely spaced apart from one another by a gauge distance and the first plurality of yarns being distributed to the needles in a first repeating color sequence;

(c) threading a second plurality of yarns through a yarn feed pattern control device to a rear row of needles, said needles of the rear row being transversely spaced apart from one another by the gauge distance and the second plurality of yarns being distributed to the needles in a second repeating color sequence;

(d) feeding a backing fabric longitudinally through the tufting machine from front to back;

(e) reciprocating the front and rear rows of needles to penetrate the backing fabric to thereby carrying loops of the first and second pluralities of yarns from a back side of the backing fabric to a face side of the backing fabric;

(f) operating loopers on the face side of the backing fabric to seize loops of the first and second pluralities of yarns;

(g) operating the yarn feed pattern control device in accordance with the pattern information and a pattern stitch offset to form relatively high loops and relatively low loops from the first and second pluralities of yarns such that the relatively high loops are displayed and relatively low loops are at least partially concealed;

wherein at least one yarn from each adjacent first repeating color sequence and second repeating color sequence is displayed from each reciprocation of the needles and the backing fabric is advanced by a distance that is approximately the reciprocal of the number of colors of yarn threaded on the needles multiplied by the composite gauge of the two rows of needles for each reciprocation of the needles.

5. The method of claim 1 wherein the spacing of the front transverse row of needles is selected from the group of $1/10^{th}$ gauge, $1/8^{th}$ gauge, $1/5^{th}$ gauge, $1/6^{th}$ gauge, and $5/32$nds gauge.

6. The method of claim 1 wherein the needles are laterally shifted by one-half the gauge of the first transverse rows of needles.

7. The method of claim 1 wherein the yarn feed control supplies yarn to form a single relatively high tuft for each set of stitches.

8. The method of claim 1 wherein the front and rear rows of spaced needles are staggered with respect to each other.

9. The method of claim 1 wherein front loopers seize yarns from the front row of needles and rear loopers seize yarns from the rear row of needles and rear yarns overtuft front yarns.

10. The method of claim 1 wherein the plurality of yarns comprises two colors of yarn threaded on the front row of needles and two colors of yarn threaded on the rear row of needles.

11. The method of claim 10 wherein the tufting machine commences operation with the front and rear rows of needles at a home position and the needles are never shifted laterally by more than two gauge units from the home position.

12. The method of claim 2 wherein the plurality of yarns comprises three colors of yarn threaded on the front row of needles and three colors of yarn threaded on the rear row of needles.

13. The method of claim 12 wherein the tufting machine commences operation with the front and rear rows of needles at a home position and the needles are never shifted laterally by more than three gauge units from the home position.

14. The method of claim 1 wherein the backing fabric is a nonwoven fabric.

15. The method of claim 4 wherein the needles are shifted by no more than one gauge distance between each penetration of the backing fabric by the needles.

16. The method of claim 4 wherein the front and rear rows of spaced needles are staggered with respect to each other.

17. The method of claim 3 wherein the needles are laterally shifted by no more than one-half the gauge distance of the front transverse rows of needles between each penetration of the backing fabric by the needles.

18. The method of claim 4 wherein the first plurality of yarns comprises two colors of yarn threaded in alternating fashion on the front row of needles to form a first repeating color sequence and two colors of yarn threaded in alternating fashion on the rear row of needles to form a second repeating color sequence.

* * * * *